US007423609B2

(12) United States Patent
Sänkelä et al.

(10) Patent No.: US 7,423,609 B2
(45) Date of Patent: Sep. 9, 2008

(54) COLLAPSIBLE PARABOLIC REFLECTOR

(75) Inventors: Jan-Olof Sänkelä, Haparanda (SE); Magnus Lundbäck, Luleå (SE)

(73) Assignee: Ayen Technology AB, Haparanda (SE)

( * ) Notice: Subject to any disclaimer, the term of this patent is extended or adjusted under 35 U.S.C. 154(b) by 0 days.

(21) Appl. No.: 11/662,403

(22) PCT Filed: Sep. 5, 2005

(86) PCT No.: PCT/SE2005/001280

§ 371 (c)(1),
(2), (4) Date: Nov. 1, 2007

(87) PCT Pub. No.: WO2006/041354

PCT Pub. Date: Apr. 20, 2006

(65) Prior Publication Data

US 2008/0068283 A1 Mar. 20, 2008

(30) Foreign Application Priority Data

Sep. 10, 2004 (SE) ..... 0402167

(51) Int. Cl.
*H01Q 15/20* (2006.01)

(52) U.S. Cl. ..... 343/915; 343/915; 343/916

(58) Field of Classification Search ..... 343/915, 343/916

See application file for complete search history.

(56) References Cited

U.S. PATENT DOCUMENTS

| | | | | |
|---|---|---|---|---|
| 4,792,815 | A | 12/1988 | Moisdon | |
| 5,061,945 | A | 10/1991 | Hull et al. | |
| 6,340,956 | B1 * | 1/2002 | Bowen et al. | 343/915 |
| 6,344,835 | B1 * | 2/2002 | Allen et al. | 343/915 |
| 6,625,288 | B1 | 9/2003 | Koizumi | |
| 6,771,229 | B2 * | 8/2004 | Thornburgh | 343/915 |

FOREIGN PATENT DOCUMENTS

| | | |
|---|---|---|
| EP | 1 332 966 | 6/2003 |

* cited by examiner

*Primary Examiner*—Trinh V Dinh
(74) *Attorney, Agent, or Firm*—Young & Thompson

(57) ABSTRACT

Parabolic reflector includes a number of sectors (2) being connected to each other at a central hub (3), the parabolic reflector being collapsible from an extended position (9), in which the sectors together extend 360 °around the hub (3), to a retracted position (8), in which the sectors (2) are brought together into a compact unit. Each sector (2) is rigid and is firmly joined to a cylindrical hub sleeve (4). The hub sleeves (4) together form the hub (3), around which the sectors (2) are journalled for limited movement around a central axis extending through the center of the hub (3). The hub sleeves (4) are concentrically arranged one radially inside the other with consecutively decreasing radii, and the hub sleeves (4) have mutually cooperating guiding surfaces that permit axial displacement of the hub so as to enable relative rotation there between.

20 Claims, 4 Drawing Sheets

COLLAPSIBLE PARABOLIC REFLECTOR

FIELD OF THE INVENTION

The invention concerns a collapsible parabolic reflector of the kind comprising a number of sectors being connected to each other at a central hub, the parabolic reflector being collapsible from an extended position, in which the sectors together extend 360° around the hub, to a retracted position, in which the sectors are brought together into a compact unit. Also, the invention relates to a parabolic antenna including such a collapsible reflector.

PRIOR ART

In the field of communication technology over long distances, for instance between earth and a satellite, it is well known to use parabolic reflectors. They are needed for amplification and concentration of the inherently weak and directional signals of long distance communication and also for improving signal to noise ratio and thus transfer bitrates.

In a world constantly demanding more flexibility and mobility there has been an increased demand for portable, independent broadband communications.

However, it is difficult to make communication equipment using antennas with parabolic reflectors portable, because of the reflectors as such. Often, they have sizes that make them cumbersome to carry and impossible to bring on a normal passenger airplane. Thus, in order to make these reflectors more portable, it would be advantageous to make them more compact.

One approach to making reflectors portable is to divide them into several smaller pieces. U.S. Pat. No. 5,061,945 illustrates an antenna reflector comprising flat plates rotatably joined together in a hub. The plates can be rotated to a first over-lapping position, where the plates are stacked one upon the other in a compact way. The plates can also be rotated into a second, spread-out position, where the plates together form essentially a circular disc. When the trailing and leading edges of the plate bundle are joined by way of a rope and at least one pulley, the flat structure transforms into a three dimensional structure with parabolic form. One drawback with this design is the need for a rope and a pulley to form the to parabolic shape of the reflector. Moreover, this forming method is cumbersome to perform. There is also a problem of attaining the correct form of the antenna, and to attain the same form every time. Small differences can have a huge impact on received signal quality.

U.S. Pat. No. 4,792,815 discloses an antenna reflector comprising parabolic petals or sectors being rotatably joined on a common polar axis. Each petal or sector constitutes one radial segment of a paraboloid that can be rotated around the common polar axis from a compact position, where they overlap each other, to an open position, forming the paraboloid. Further, the reflector includes petal support braces, to hold the shape of the petals. In one embodiment that holding function is performed by a thin sheet material that covers each petal. The need for support means to keep the petal segments in place is a disadvantage. Whether in the form of wire braces or thin plastic film, they interfere with the line of sight of the reflector. They also complicate the mounting and dismounting of the reflector and make it a complex construction.

Other constructions for foldable antennas include designs with loose parts that are put together. That makes them cumbersome to assemble and there is a risk that parts may be lost.

OBJECT OF THE INVENTION AND ITS MOST IMPORTANT CHARACTERISTICS

It is an object of the invention to overcome one or more of the problems with the prior art above. Thus, it should provide a reflector which is collapsible into a compact package. The reflector should be simple in construction and sufficiently stable, without the need for additional support devices or loose parts. Moreover, it should be easy to assemble and disassemble, for rapid deployment.

According to the invention, this is achieved by a device having the features defined in claim 1 and in claim 10, respectively.

According to the invention, the collapsible reflector comprises a number of rigid sectors being connected to each other at a central hub. The sectors are mutually rotatable around the hub, so that the reflector is collapsible from an extended position, in which they are spread out 360° around the hub, into a retracted position. In the retracted position, the sectors are stacked upon each other, while still being connected at the hub. The hub is constituted by a number of hub sleeves that are concentrically arranged, one radially inside the other, with consecutively decreasing radii. Each hub sleeve has a circular cylindrical form and is firmly joined to an associated sector. The hub sleeves are movable in relation to each other rotatably around and axially along a central axis extending through the center of the hub, but only in a prescribed manner. Mutually cooperating guiding surfaces ensure that any hub sleeve is rotatable inside another hub sleeve after being lifted somewhat in the axial direction of the hub.

From a fully retracted position, where the sectors are stacked together as a compact unit, any hub sleeve is movable, when lifted axially, only in one rotational direction inside the next larger sleeve. On the other hand, in the extended position, where the sectors are spread out side by side, the hub sleeves can only be rotated in the other direction, upon being lifted axially, in relation to an adjoining sleeve.

The sectors of the reflector may or may not be of equal size and their number may also vary according to the specifications of a specific reflector. The number of sectors could for instance be three or more, preferably at least four, possibly six or an even higher number.

The mechanically robust design of the hub enables the sectors of the reflector to be rigid, without loss of stability.

Advantageously, the hub is placed on the back of the reflector, i.e. on the non-reflective side thereof.

The above mentioned guiding surfaces may be constituted by grooves made in the hub sleeves and corresponding guide pins projecting radially outwards, so as to engage with the groove in the surrounding hub sleeve.

On at least some of the hub sleeves there is formed a flange that protrudes radially outwards from the sleeve. These flanges are arranged in such a way that, in the extended position, they are locked side by side, edge to edge. In this way they form a continuous, planar annular surface. Preferably these flanges serve as holding means for firm connection of an associated sector. Alternatively, the hub sleeve and the associated sector may be integrally formed and cast in one piece. Materials for the hub (3) and the sectors (2) can be chosen independently from each other, for instance from the group consisting of: carbon fiber composite, other composites, aluminium, steel.

The parabolic reflector according to the invention is normally used as a parabolic antenna, including at least one antenna element located on an axis of the reflector.

Further features and advantages will be apparent from the following description of a preferred embodiment.

BRIEF DESCRIPTION OF THE DRAWINGS

A preferred embodiment of the reflector according to the invention will now be described with reference to the appended drawings, on which.

DESCRIPTION OF PREFERRED EMBODIMENTS

Figure 1A:
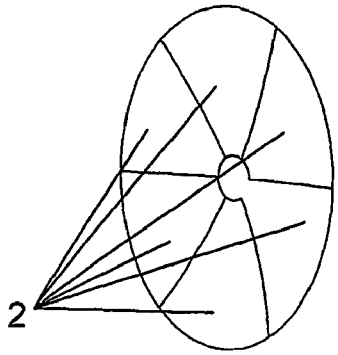
FIGS. 1A and 1B illustrate a reflector dish from the front and from the back, respectively, FIGS. 2A, 2B, 2C and 2D, respectively, illustrate different stages in a mounting process from a retracted to an extended position.
Figure 1B:
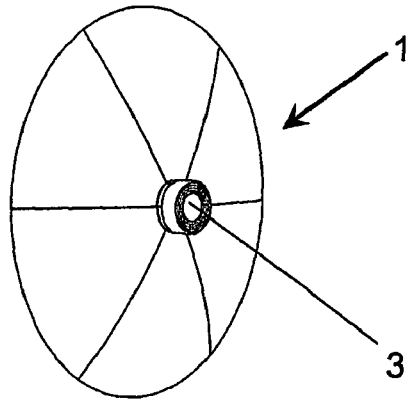

The reflector 1 shown in FIGS. 1A and 1B is divided into sectors 2, in this case four sectors, which are connected at a central hub 3. A wide range of sizes of the reflector could be anticipated, for example between 0.6 and 2.5 m in diameter. Preferably, the reflector would be about 1 m in diameter.

Figure 2A:
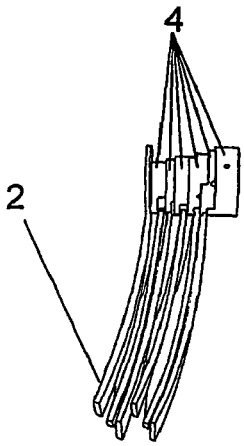
Figure 2B:
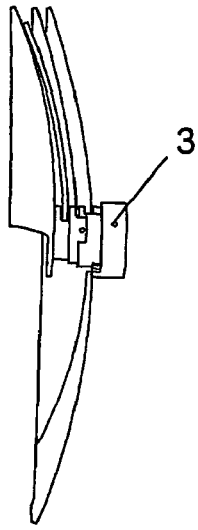
Figure 2C:
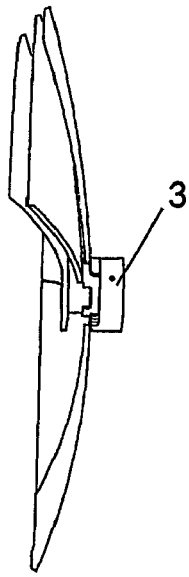
Figure 2D:
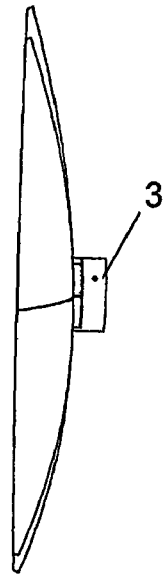

FIGS. 2A through 2D illustrate different positions of the sectors 2 during a mounting or unfolding process from a retracted position (FIG. 2A) to an extended position (FIG. 2D). In a fully extended position, as in FIG. 2D, the sectors 2 extend 360° around the hub in a seamless, edge to edge fashion. In a fully retracted position, as in FIG. 2A, the sectors 2 overlap each other, so as to form a compact unit. As can be best seen in FIG. 2A, the hub 3 is constituted by a number of hub sleeves 4, each being firmly connected to an associated sector 2. The hub sleeves 4 are concentrically arranged one radially inside the other, with consecutively decreasing radii. The sectors 2 may follow an angular path from the retracted position to the extended position, or vice versa, by a circumferential movement around the central axis of the hub 3. During this motion, the hub sleeves 4 are rotated in relation to each other in a well defined, restricted way.

The sleeves 4 are arranged with a relatively close fit one inside the other and have mutually cooperating guiding surfaces 5, 6 (FIG. 3A,B) that limit the mobility of the sleeves 4. In a first position, relative turning of two adjoining hub sleeves 4 is not permitted and in a second position, where sleeves 4 are axially displaced from the first position, turning is permitted. When the sectors 2 and the sleeves 4 are located in the fully extended position (FIG. 2D) and one sleeve is in the second, axially displaced, position, relative turning motion of this sleeve and the adjoining sleeve is only permitted moving the sleeves rotatably towards each other. That is to say, in this position the sleeves may be brought closer to each other, thus overlapping, but may not be brought from each other. All sleeves are arranged in this way relative adjoining sleeve.

So, a typical folding of an extended reflector could evolve as follows. From the completely extended position (FIG. 2D) of the reflector, a first sector is lifted above the others. This sector could for instance correspond to the hub sleeve with the smallest diameter. As the sector is lifted, the hub sleeve of that sector moves a corresponding length along the axis of the hub. As the sleeve reaches the end position of this axial movement, the guiding surfaces of this sleeve and the adjoining one with larger diameter now permits the lifted sleeve to be rotated around the axis of the hub. Turning is only possible in one direction, namely the one in which the lifted sector starts to overlap with the sector that is associated with the adjoining, larger, hub sleeve. The sector reaches its end turning position when it is completely aligned over the adjoining sector. Next, this sector, together with the sector stacked above it, in a similar fashion, is lifted above the others. When they reach the end position of the axial lifting movement, they can be rotated over the next adjoining sector. This procedure continues until all sectors are stacked above each other.

The sectors 2 of the reflector can have any angular spread and can be of different sizes relative to each other. This is a matter of design to achieve the desired properties of the reflector. One may want to achieve a symmetrical reflector, an asymmetrical reflector for an offset antenna, etc. Typically though, the reflector will be divided into equally large sectors 2. They can for instance be three or more, preferably at least four, possibly six or an even higher number.

Because of the mechanically very robust design of the hub 3, the sectors 2 can be made rigid without needing any extra stabilizing means. Due to the rigidity of the sectors, the reflector can be made to correspond very accurately with a desired form. This enhances signal quality with an antenna.

If the hub 3 is placed on the back of the reflector, i.e. the side of the reflector that is not facing the receiver/transmitter of a parabolic antenna, it will not interfere with reception and/or transmission.

Figure 3A:
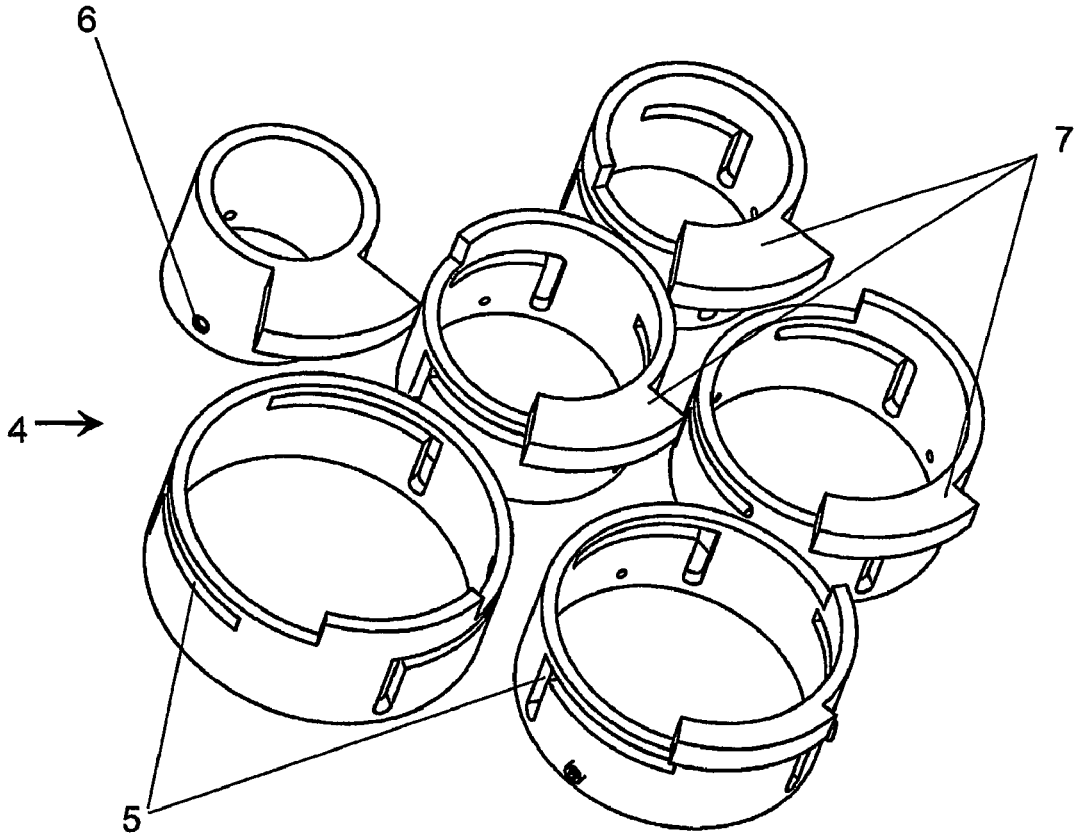
FIGS. 3A and 3B illustrate different hub sleeves from above and from below, and FIGS. 4A, 4B and 4C, respectively, illustrate the hub in different positions.
Figure 3B:
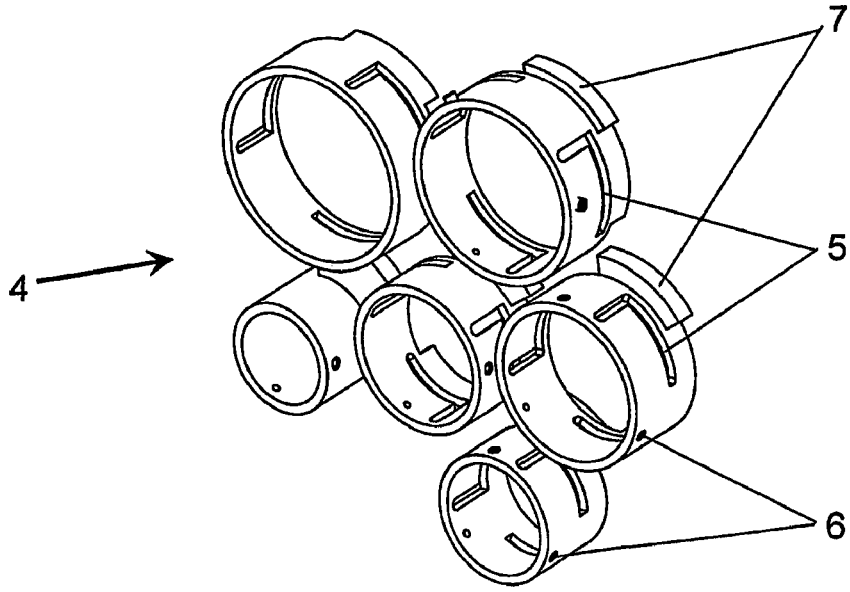

FIGS. 3A and 3B illustrate the hub sleeves 4 of the hub and one embodiment of guiding surfaces, in the form of grooves 5 and guide pins 6. The guide pins 6 engage with the grooves 5 of a larger hub sleeve. The grooves 5 will guide the movement of the pins 6 and in this way the particular, restricted mutual motion of the hub sleeves is obtained. There are of course many other possible designs that will yield the same functionality. For example, instead of guide pins 6, it would be possible to use guide shoulders. These would be more massive parts of the hub sleeve than the guide pins and would possibly make the construction even more mechanically stable.

Figure 4A:
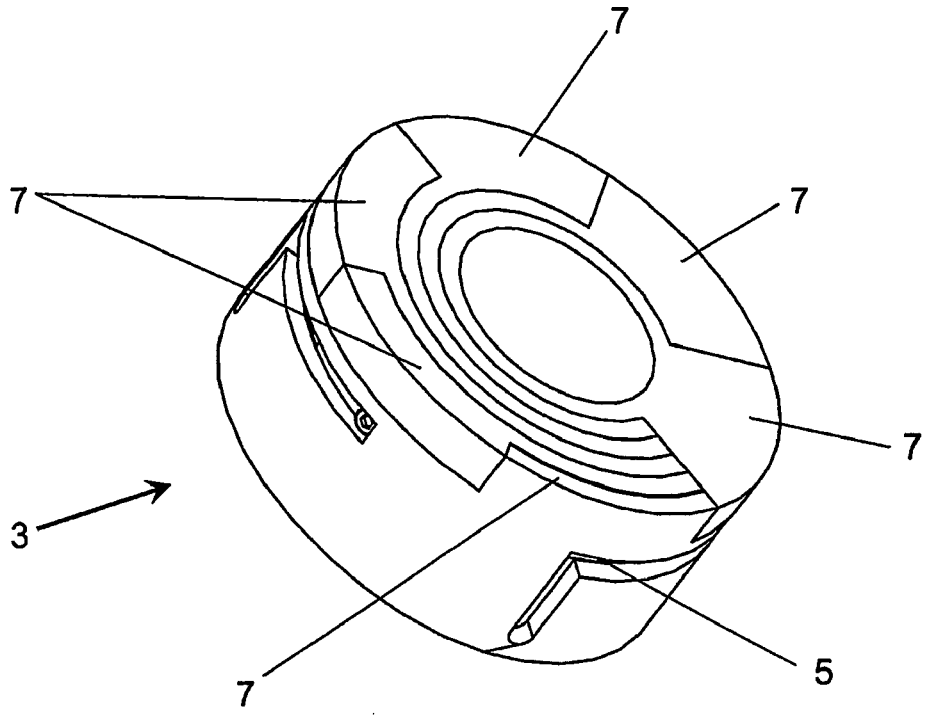
Figure 4B:
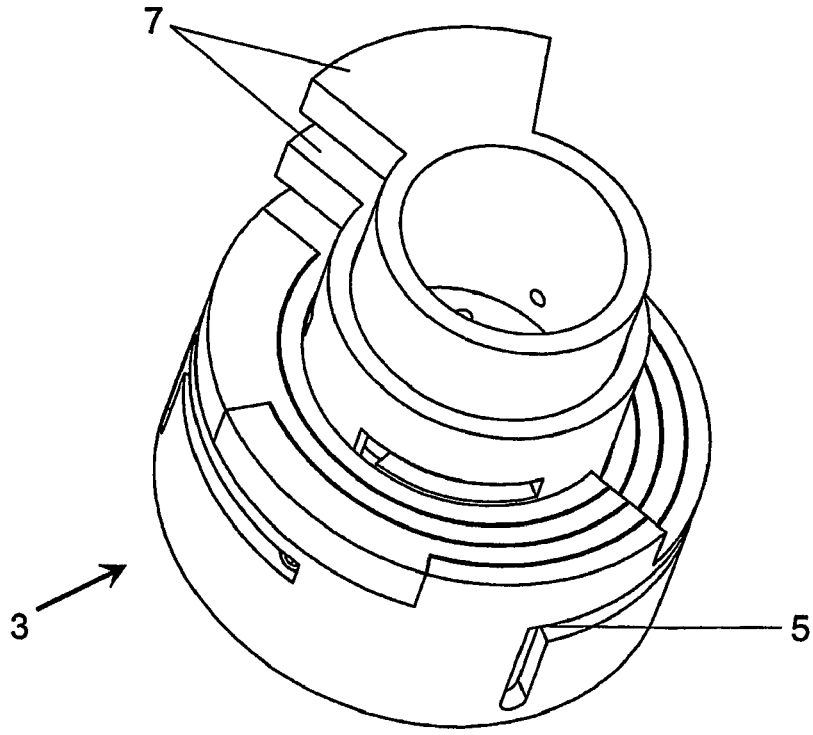
Figure 4C:
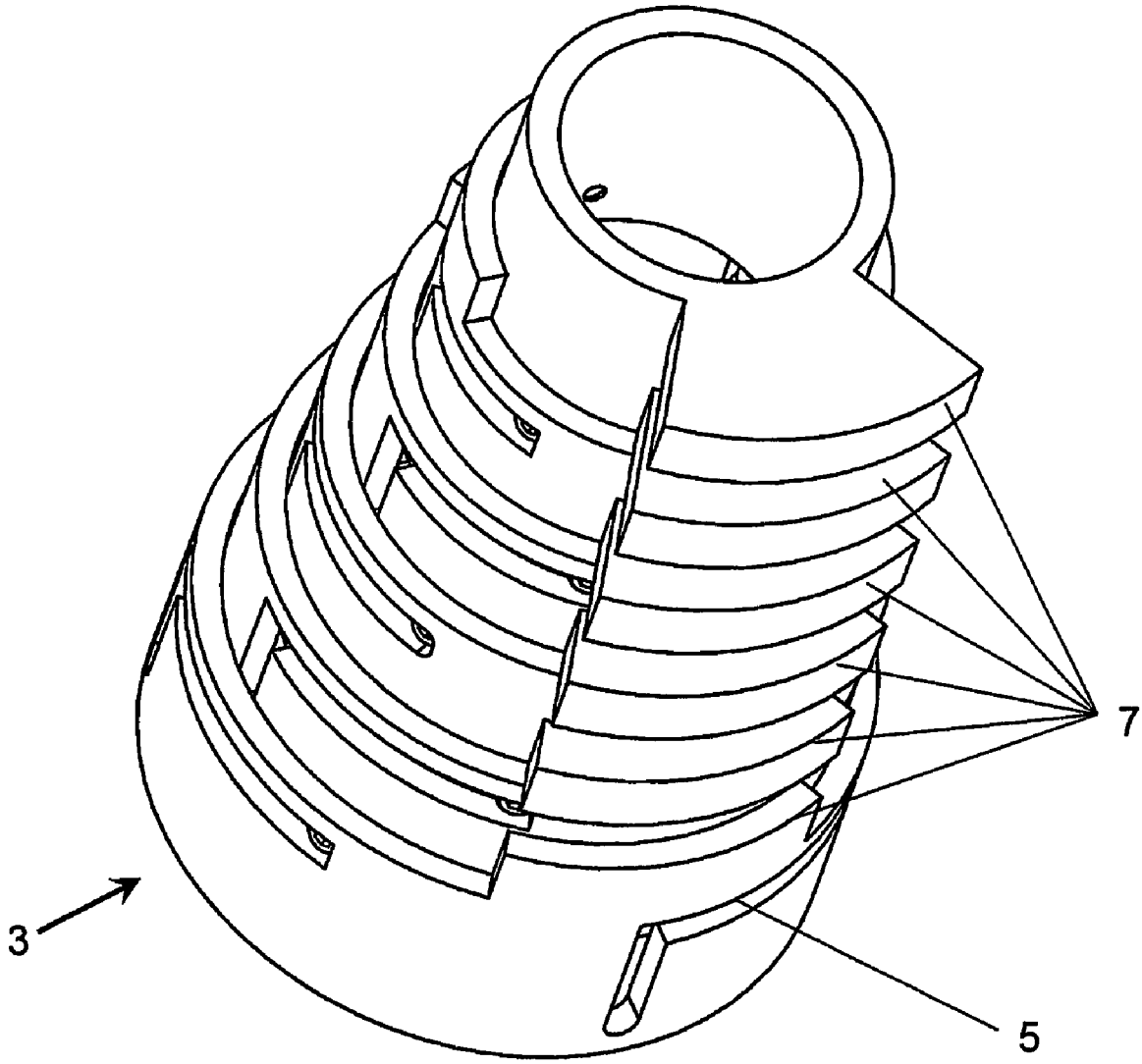

In FIG. 4A through 4C, the hub 3 is seen in different positions that correspond to different degrees of folding of the reflector. In the figures it can clearly be seen that at least some of the hub sleeves has a flange 7 that protrudes radially from the axis of the hub 3. When the reflector is in the completely extended position as in FIG. 4A, these flanges 7 are arranged side by side, edge to edge and form a continuous, planar annular surface. As the reflector is being stacked into the compact, retracted position, the flanges 7 are also stacked above each other. This can be seen in FIGS. 4B and 4C. With each flange 7, a sector 2 (FIG. 2A-D) is firmly connected, the sector 2 belonging to that flange.

The hub 3 and the sectors 2 could be produced from a variety of different materials, for instance: carbon fiber composite, other composites, aluminium or steel. They could be made of the same material or from different ones. All materials that can be given desired properties, such as rigidity, reflectivity and machining properties may be considered. Carbon fiber composite for the sectors and aluminium for the hub sleeves is preferred.

The sectors 2 can be joined at the flanges 7 of the associated hub sleeves 4 with glue and/or screws. Other conventional connectional means could also be used, such as welding seams, rivets etc. As an alternative, casting of a sector and a hub sleeve in one integral piece is also possible.

The reflector of the invention is normally used as a part of parabolic antenna transmission/reception system. Such a system would at least include one antenna element and the reflector of the invention. Advantageously it would be used in a foldable and portable embodiment of such a system.

The invention claimed is:

1. Parabolic reflector (1) comprising a number of sectors (2) being connected to each other at a central hub (3), the parabolic reflector (1) being collapsible from an extended position (9), in which the sectors together extend 360° around the hub (3), to a retracted position (8), in which the sectors (2) are brought together into a compact unit, characterised in that each sector (2) is rigid and is firmly joined to a cylindrical hub sleeve (4), that the hub sleeves (4) together form said hub (3), around which the sectors (2) are journalled for limited movement around a central axis extending through the center of the hub (3), that the hub sleeves (4) are concentrically arranged one radially inside the other with consecutively decreasing radii, and that the hub sleeves (4) have mutually cooperating guiding surfaces (5,6) that permit axial displacement of the hub so as to enable relative rotation there between.

2. Reflector according to claim 1, characterised in that said guiding surfaces permit a limited axial displacement of the hub sleeves of any pair of adjoining hub sleeves (4) between a first axial position, in which these adjoining hub sleeves (4) are mutually non-rotatable, and a second axial position in which the adjoining hub sleeves (4) are mutually rotatable.

3. Reflector according to claim 2, characterterised in that the hub sleeves (4), when being in said second axial position, and the sector associated with such a sleeve is in a full overlap with an adjoining sector, are movable in one direction of rotation only.

4. Reflector according to claim 3, characterised in that the reflector (1) includes at least three different sectors (2).

5. Reflector according to claim 3, characterised in that the hub (3) is located at the back of the reflector.

6. Reflector according to claim 3, characterised in that the guiding surfaces (5,6) of the hub sleeves (4) comprise mutually engaging grooves (5) and guide pins (6).

7. Reflector according to claim 2 characterised in that the reflector (1) includes at least three different sectors (2).

8. Reflector according to claim 2, characterised in that the hub (3) is located at the back of the reflector.

9. Reflector according to claim 2, characterised in that the guiding surfaces (5,6) of the hub sleeves (4) comprise mutually engaging grooves (5) and guide pins (6).

10. Reflector according to claim 2, characterised in that at least some of the hub sleeves (4) are provided with radially protruding flanges (7) arranged so as to form a continuous, planar surface in the retracted position of the reflector.

11. Reflector according to claim 1, characterised in that the reflector (1) includes at least three different sectors (2).

12. Reflector according to claim 11, characterised in that the hub (3) is located at the back of the reflector.

13. Reflector according to claim 11, characterised in that the guiding surfaces (5,6) of the hub sleeves (4) comprise mutually engaging grooves (5) and guide pins (6).

14. Reflector according to claim 1, characterised in that the hub (3) is located at the back of the reflector.

15. Reflector according to claim 14, characterised in that the guiding surfaces (5,6) of the hub sleeves (4) comprise mutually engaging grooves (5) and guide pins (6).

16. Reflector according to claim 1, characterised in that the guiding surfaces (5,6) of the hub sleeves (4) comprise mutually engaging grooves (5) and guide pins (6).

17. Reflector according to claim 1, characterised in that at least some of the hub sleeves (4) are provided with radially protruding flanges (7) arranged so as to form a continuous, planar surface in the retracted position of the reflector.

18. Reflector according to claim 17, characterised in that each of said flanges (7) are firmly connected to an associated sector (2).

19. Reflector according to claim 1, characterised in that the hub (3) and the sectors (2) are made from materials chosen independently from each other, from the group consisting of: carbon fiber composite, other composites, aluminium, steel.

20. Parabolic antenna including at least one antenna element and a reflector (1) according to claim 1.

* * * * *